US007059916B2

(12) United States Patent
Nishide

(10) Patent No.: US 7,059,916 B2
(45) Date of Patent: Jun. 13, 2006

(54) DIVIDED CONNECTOR, A METHOD OF ASSEMBLING IT AND A METHOD OF CONNECTING IT WITH A MATING CONNECTOR

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/977,690

(22) Filed: Oct. 29, 2004

(65) Prior Publication Data

US 2005/0095921 A1 May 5, 2005

(30) Foreign Application Priority Data

Oct. 29, 2003 (JP) ..... 2003-368916
Oct. 31, 2003 (JP) ..... 2003-371665

(51) Int. Cl.
*H01R 13/502* (2006.01)

(52) U.S. Cl. ..... 439/686

(58) Field of Classification Search ..... 439/701, 439/686, 924.1, 676, 689
See application file for complete search history.

(56) References Cited

U.S. PATENT DOCUMENTS 6,547,605 B1 * 4/2003 Daugherty et al. ..... 439/686
6,582,256 B1 * 6/2003 Sakurai et al. ..... 439/701
6,592,410 B1 * 7/2003 Yoshida et al. ..... 439/701
6,638,108 B1 * 10/2003 Tachi ..... 439/595
2002/0151202 A1 10/2002 Tachi et al.
2002/0173198 A1 11/2002 Plate

FOREIGN PATENT DOCUMENTS

DE 298 04 728 U1 8/1999
JP 2000-331738 11/2000

* cited by examiner

*Primary Examiner*—Phuong Dinh
(74) *Attorney, Agent, or Firm*—Gerald E. Hespos; Anthony J. Casella

(57) ABSTRACT

A divided connector (10) has a housing main body (11) with main cavities (16) and main front walls (17) that define front limit positions for main terminal fittings (15) in the main cavities (16). The housing main body (11) also has an accommodating portion (12) with an accommodating front wall (13) that defines a front limit position for an auxiliary housing (30) in the accommodating portion (12). The auxiliary housing (30) has auxiliary cavities (32) with auxiliary front walls (33) that define front limit positions of auxiliary terminal fittings (31) in the auxiliary cavities (32). A sum of the thicknesses of auxiliary front walls (33) and the accommodating front wall (13) exceeds the thickness of main front walls (17). Thus, the auxiliary terminal fittings (31) are backward from the main-body terminal fittings (15) by this thickness difference and a peak connecting force is reduced.

6 Claims, 15 Drawing Sheets

DIVIDED CONNECTOR, A METHOD OF ASSEMBLING IT AND A METHOD OF CONNECTING IT WITH A MATING CONNECTOR

BACKGROUND OF THE INVENTION

1. Field of the Invention

The invention relates to a divided connector.

2. Description of the Related Art

A divided connector has been used to achieve operational efficiencies upon insertion of terminal fittings into a connector. For example, Japanese Unexamined Patent Publication No. 2000-331738 shows a divided connector with a housing main body and a separate auxiliary housing that is accommodated into an accommodating portion in the housing main body. Cavities for accommodating the terminal fittings are provided both in the housing main body and in the auxiliary housing.

The above-described divided connector can be connected with a mating connector. However, significant insertion resistance is created between the terminal fittings and mating terminal fittings. Thus, a large force is required to connect the two connectors. Additionally, peak values of the connecting force for the several terminal fittings start at the same time and become extremely large if the terminal fittings are substantially identical terminal.

The invention was developed in view of the above problem and an object is to improve operability in connecting a divided connector with a mating connector.

SUMMARY OF THE INVENTION

The invention relates to a divided connector with a housing main body formed with one or more cavities for receiving main-body terminal fittings. The housing main body also has an accommodating portion for receiving an auxiliary housing. The auxiliary housing is formed with cavities for receiving at least one auxiliary-connector terminal fitting. Mount positions of the main-body terminal fittings and mount positions of the auxiliary-connector terminal fittings are displaced along a connecting direction of the divided connector with a mating connector. Thus, the peak insertion resistance between the main-body terminal fittings and mating terminal fittings does not occur simultaneously with the peak insertion resistance between the auxiliary-connector terminal fittings and the mating terminal fittings. As a result, a peak value of a connecting force to connect the two connectors is reduced, thereby improving operational efficiency.

The auxiliary-connector terminal fittings have substantially the same shape as the main-body terminal fittings.

Auxiliary-connector front walls are at the front ends of the cavities in the auxiliary housing for stopping the auxiliary-connector terminal fittings at their front end positions. Main-body front walls are at the front ends of the cavities in the housing main body for stopping the main-body terminal fittings at front end positions and at least one front wall is at the front end of the accommodating portion for stopping the auxiliary housing at a front-end position.

A sum of the thicknesses of the auxiliary-connector front walls and the front wall of the accommodating portion preferably exceeds the thickness of the main-body front wall. Thus, the mount positions of the auxiliary-connector terminal fittings are displaced back from the mount positions of the main-body terminal fittings by this thickness difference. In this way, the connection timing of the auxiliary-connector terminal fittings with the mating terminal fittings are shifted from the connection timing of the main-body side terminal fittings with the mating terminal fittings.

A retainer preferably is mounted at a restricting position in the housing main body to lock the main-body side terminal fittings at least partly in the housing main body.

The auxiliary housing does not interfere with the retainer and permits the retainer to be mounted at the restricting position when the auxiliary housing is at a proper mount position in the housing main body. However, the auxiliary housing interferes with the retainer and prevents the retainer from being mounted to the restricting position when the auxiliary housing is at a position displaced back from the proper mount position.

The retainer may be integral or unitary with the housing main body.

These and other features of the invention will become more apparent upon reading the following detailed description of preferred embodiments and accompanying drawings.

DETAILED DESCRIPTION OF THE PREFERRED EMBODIMENTS

Figure 1:
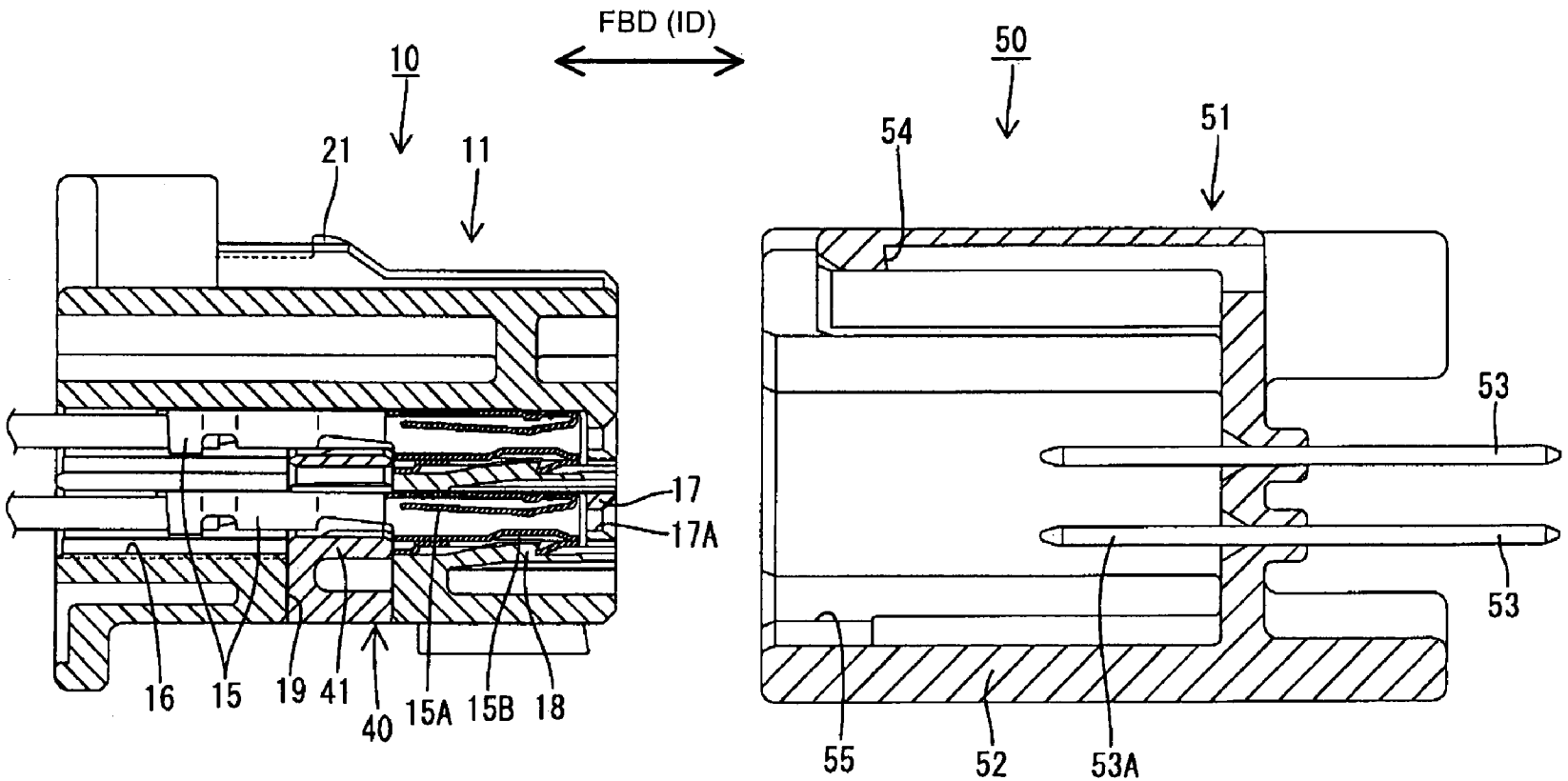
FIG. 1 is a side view in section showing a state before male and female connectors are connected in one embodiment of the invention.

A female divided connector according to the invention is identified generally by the numeral 10 in FIGS. 1 to 15. The divided connector 10 includes a housing main body 11, at least one auxiliary connector 30 to be accommodated in the housing main body 11, and two retainers 40 to be mounted into a lower part of the housing main body 11. The divided connector 10 is connectable with a male connector 50. In the following description, ends of the male and female connectors 50, 10 to be connected with each other are referred to as the front. Additionally, the terms upper and lower are provided as a convenient frame of reference, but are not intended to imply a required gravitational frame orientation.

Figure 2:
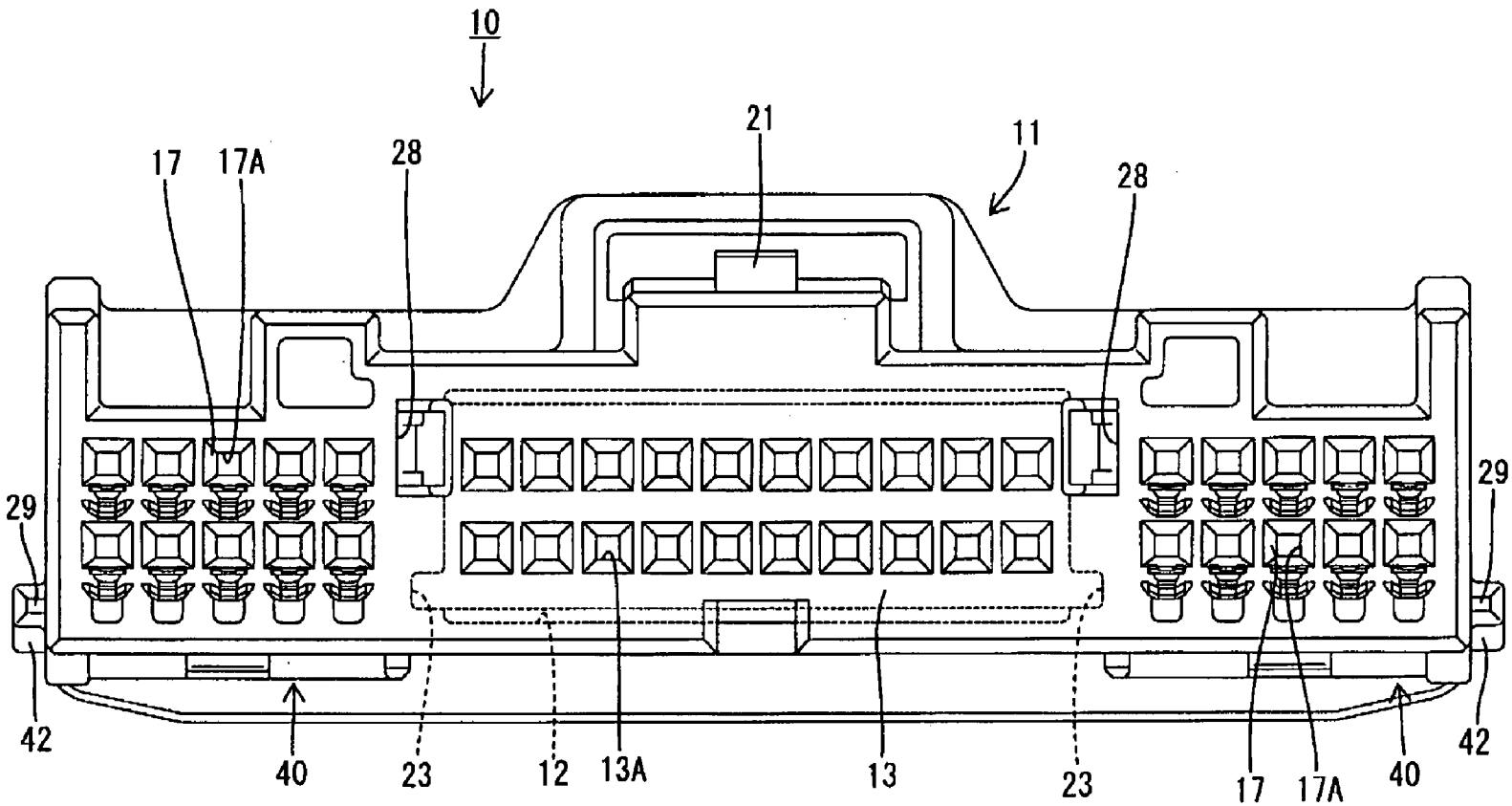
FIG. 2 is a front view of a housing main body.
Figure 3:
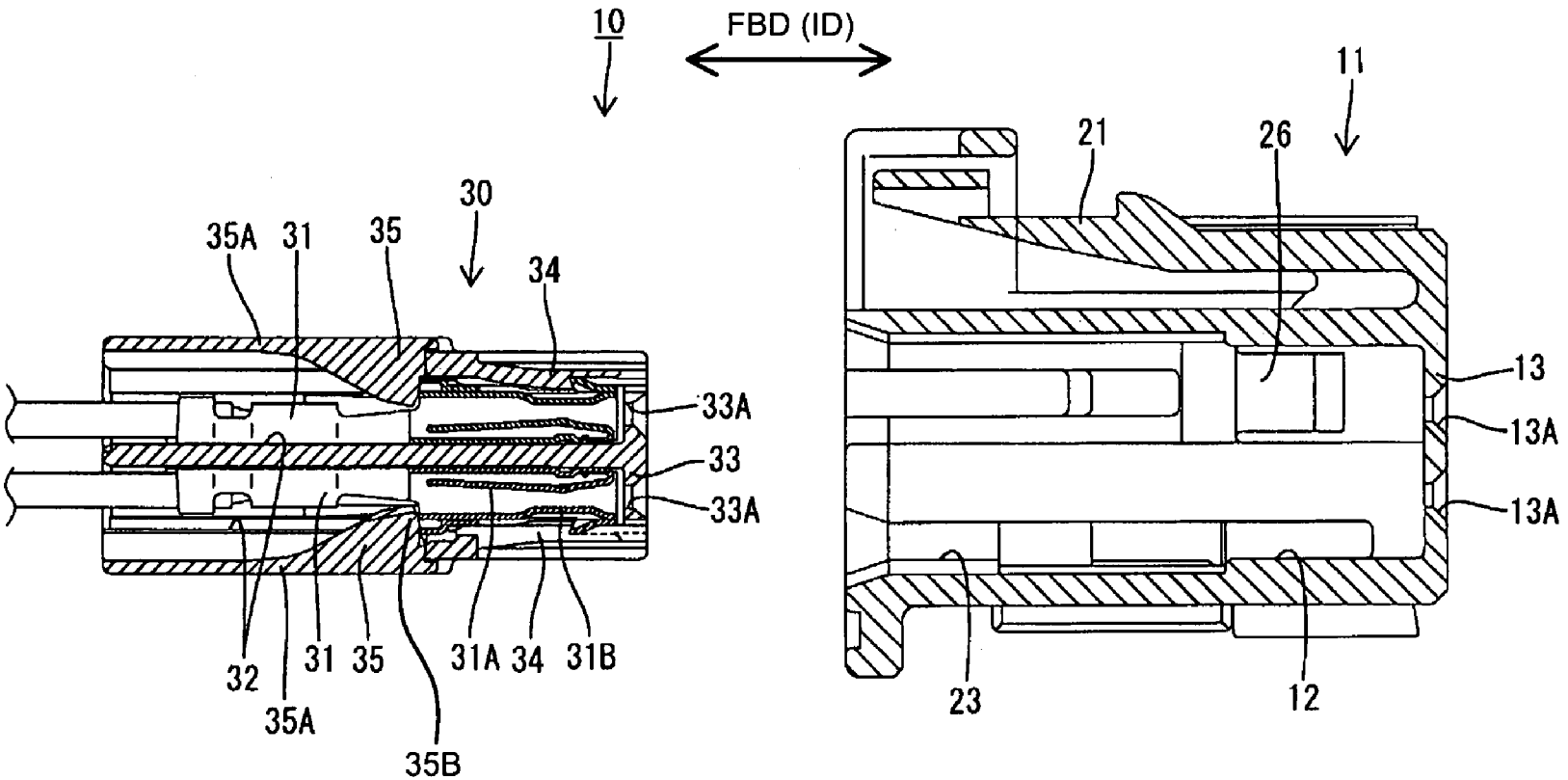
FIG. 3 is a side view in section showing a state before an auxiliary connector is assembled into the housing main body.
Figure 4:
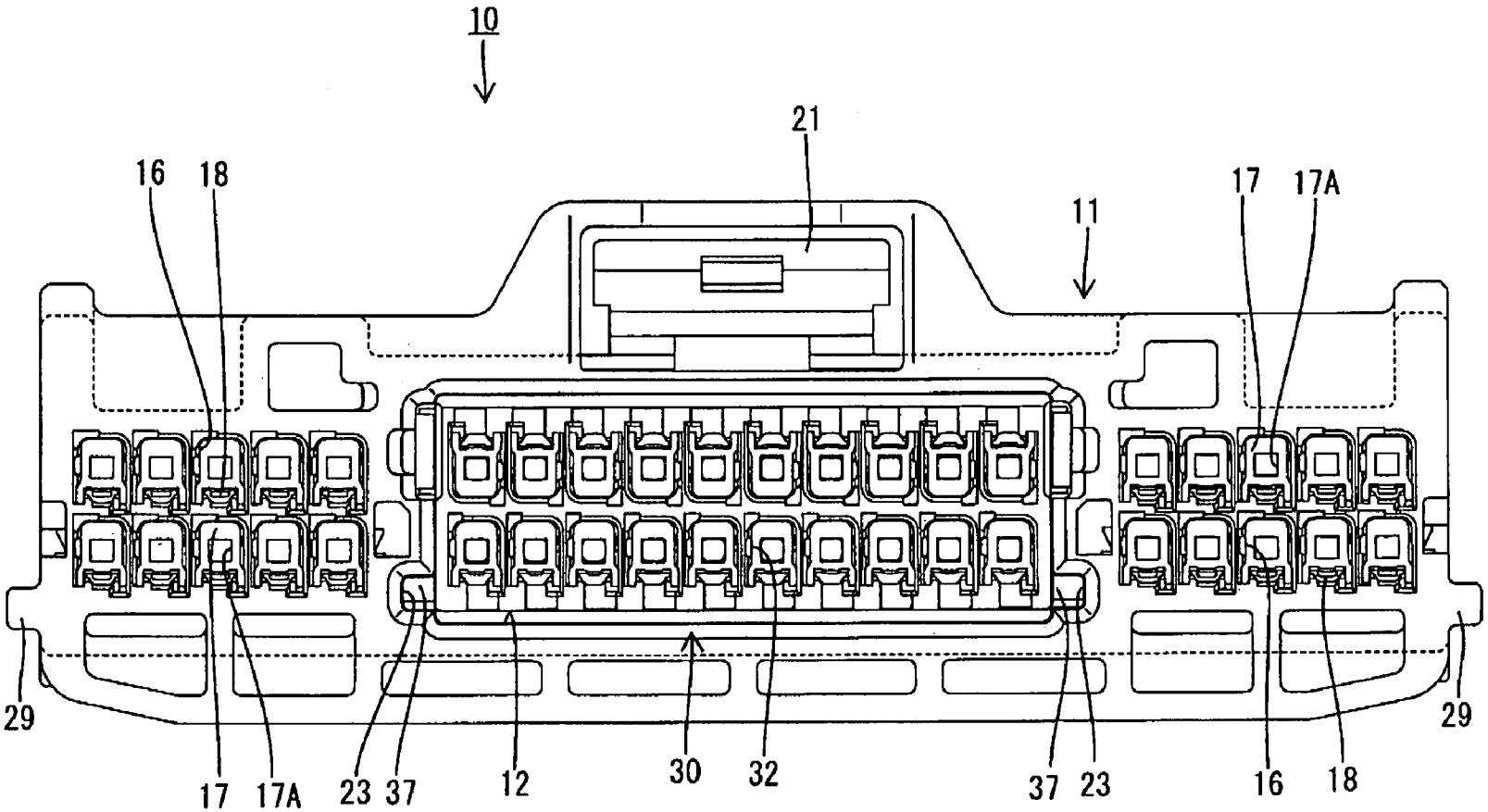
FIG. 4 is a rear view of the female connector.

The housing main body 11 is made e.g. of a synthetic resin and is in the form of a wide box. An accommodating portion 12 is formed in a widthwise intermediate portion of the housing main body 11 and has an open rear end, as shown in FIGS. 2 to 4. The auxiliary connector 30 can be inserted into the accommodating portion 12 in an insertion direction ID. A front wall 13 extends across the front surface of the accommodating portion 12 for stopping the auxiliary connector 30 at its front-end position, and tab insertion holes 13A penetrate the front wall 13 at positions corresponding to cavities 32 of the auxiliary connector 30. Cavities 16 are arranged in the housing main body 11 in arrays disposed symmetrically at opposite sides of the accommodating portion 12. Each array of cavities 16 has upper and lower stages. Female terminal fittings 15 are inserted into the cavities 16. Each female terminal fitting 15 has a resilient contact 15A at its front, and is electrically connectable with a male terminal fitting 53. More particularly, a tab 53A of the male terminal fitting 53 is insertable into a space between the resilient contact 15A and a receiving portion 15B that projects from the surface facing the resilient contact 15A. A front wall 17 is provided at the front end of each cavity 16 for stopping the female terminal fitting 15 at its front-end position, and a tab insertion hole 17A penetrates the front wall 17. The front walls 17 of the cavities 16 and the front wall 13 of the accommodating portion 12 substantially align at the front surface of the housing main body 11. However, the front walls 17 of the cavities 16 are slightly thicker than the front wall 13 of the housing main body (see FIG. 13). A lock 18 is provided on the bottom surface of each cavity 16 near the front end and is supported at both front and rear ends. The lock 18 is vertically resiliently deformable and engages the inserted female terminal fitting 15 for primary locking. Two retainer mount holes 19 are formed in the lower part of the housing main body 11 at positions corresponding to the groups of the cavities 16 and near middle portions with respect to forward and backward directions FBD (see FIG. 1). The retainers 40 are mounted from below into the retainer mount holes 19 in a direction intersecting the forward and backward directions FBD, preferably substantially normal thereto. Further, a vertically resiliently deformable lock arm 21 is cantilevered from a transverse intermediate position of the upper surface of the housing main body 11.

Figure 5:
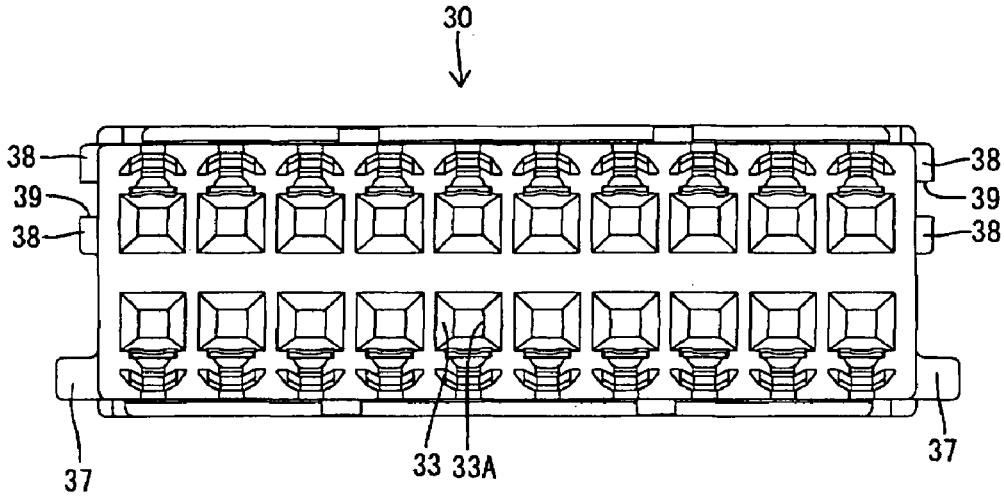
FIG. 5 is a front view of the auxiliary connector.

The auxiliary connector 30 is made e.g. of a synthetic resin and is in the form of a wide box that can be inserted from behind into the accommodating portion 12 of the housing main body 11, as shown in FIGS. 3 to 5. Cavities 32 are formed at upper and lower stages in the auxiliary connector 30 for receiving female terminal fittings 31. A resilient contact 31A is formed at the front of each female terminal fitting 31 and a receiving portion 31B projects from a surface facing the resilient contact 31A. A tab 53A of the male terminal fitting 53 can be received in a space between the resilient contact 31A and the receiving portion 31B to connect the female terminal fitting 31 electrically with the male terminal fitting 53. The female terminal fittings 31 are of the same kind as the female terminal fittings 15, and the number of female terminal fittings 15 equals the number of female terminal fittings 31. A front wall 33 is provided at the front end of each cavity 32 for stopping the female terminal fitting 31 at a front-end position, and tab insertion holes 33A penetrate the front wall 33 into the cavities 32. A resiliently deformable lock 34 is provided near the front of each cavity 32 and engages the inserted female terminal fitting 31 for primary locking. Retainers 35 are provided unitarily on the upper and lower surfaces of the auxiliary connector 30 via thin hinges 35A (see also FIG. 9) and can be opened and closed. The female terminal fittings 31 can be inserted in and withdrawn from the cavities 32 when the retainers 35 are opened. However, engaging projections 35B of the retainers 35 enter the cavities 32 (FIG. 3) to engage the female terminal fittings 31 when the retainers 35 are closed to lock the terminal fittings secondarily.

Figure 13:
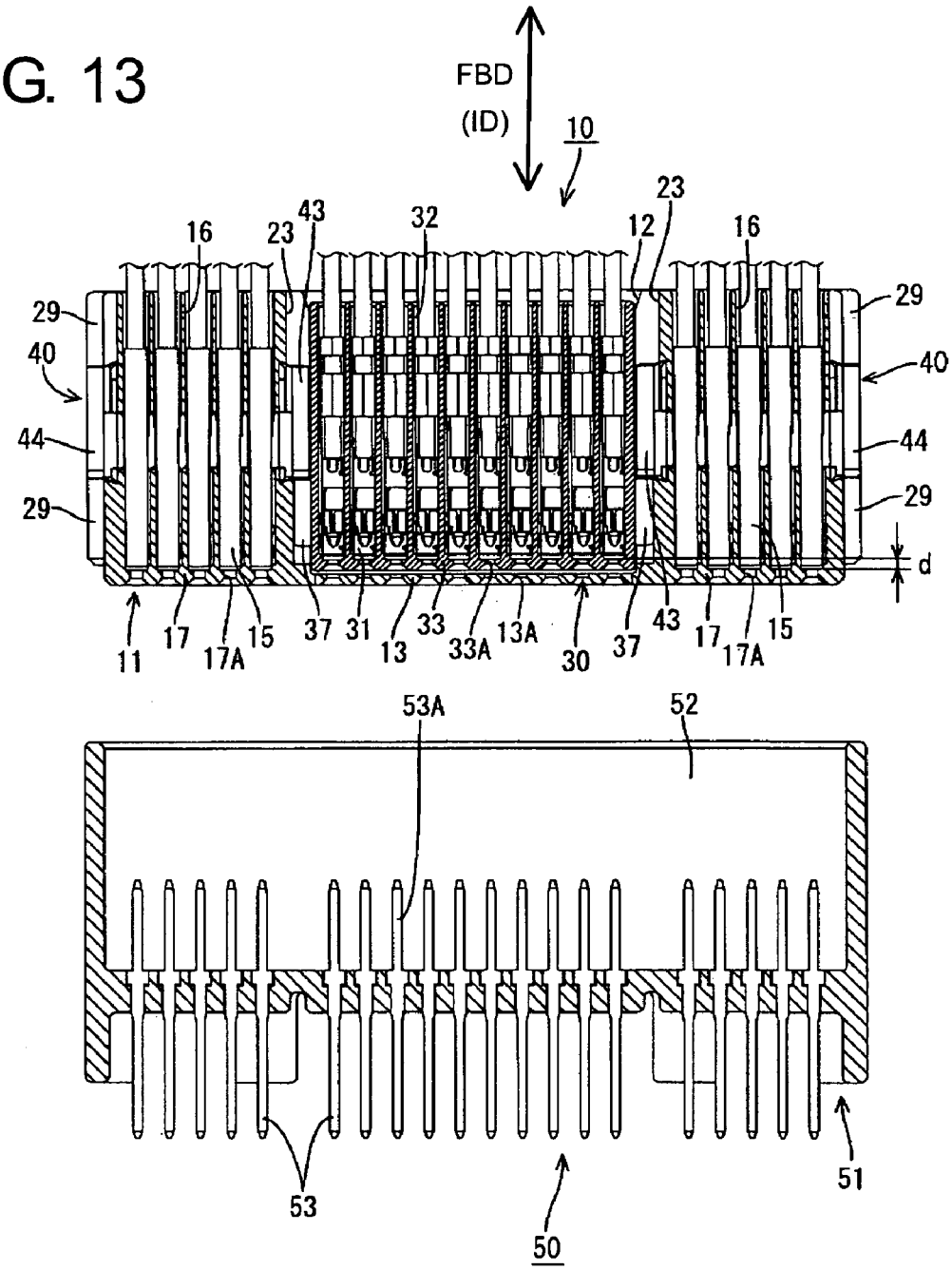
FIG. 13 is a plan view in section showing a state before the male and female connectors are connected.
Figure 14:
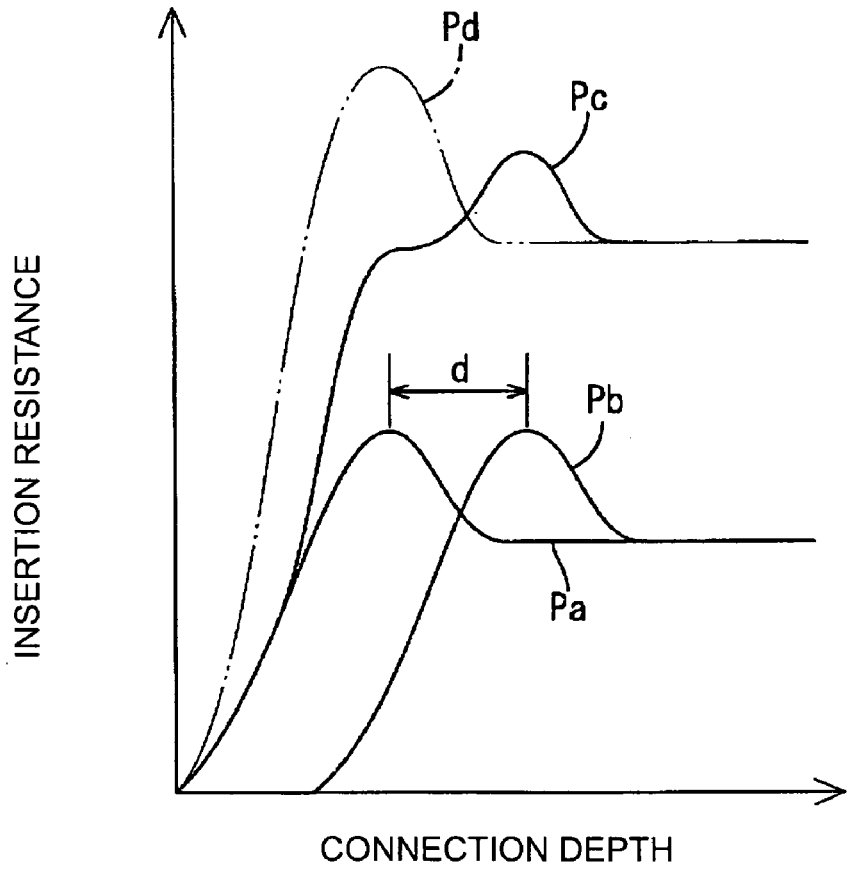
FIG. 14 is a graph showing transitions of insertion resistances created between male and female terminal fittings.

A sum of the thicknesses along the forward and backward directions FBD of the front wall of the accommodating portion 12 and the front wall 33 of each cavity 32 in the auxiliary connector 30 exceeds the thickness of the front walls 17 of the cavities 16 in the housing main body 11 by a dimension d (see e.g. FIG. 13). Thus, the female terminal fittings 31 in the cavities 32 of the auxiliary connector 30 are displaced along the forward and backward directions FBD from the female terminal fittings 15 in the housing main body 11 by the dimension d when the auxiliary connector 30 is inserted to a proper mount position where the front wall 33 of the auxiliary connector 30 contacts the front wall 13 of the accommodating portion 12, as shown in FIG. 13.

Figure 6A:
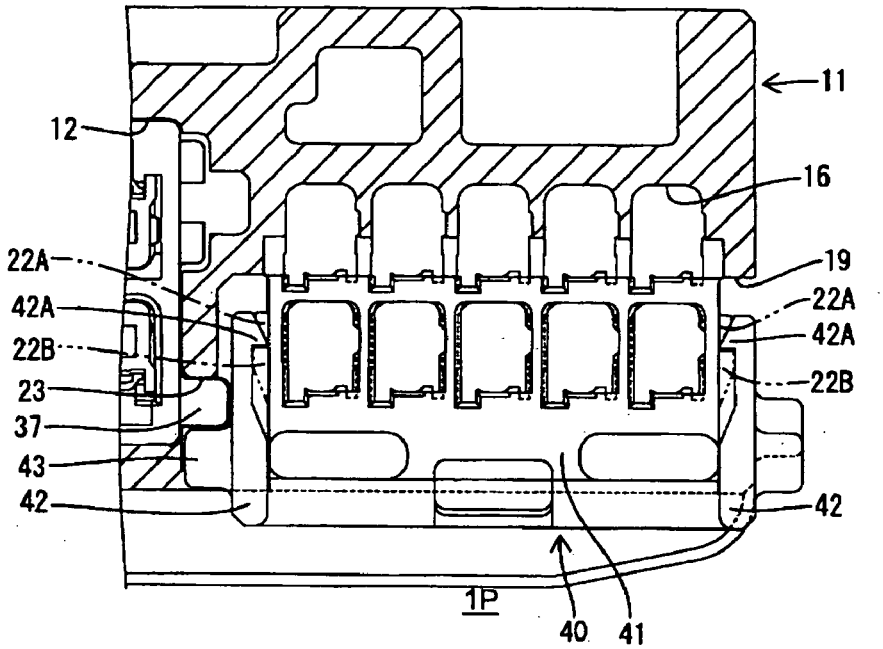
FIGS. 6(A) and 6(B) are partial enlarged sections showing a state where a retainer is mounted at a partial locking position and a state where the retainer is mounted at a full locking position, respectively.
Figure 6B:
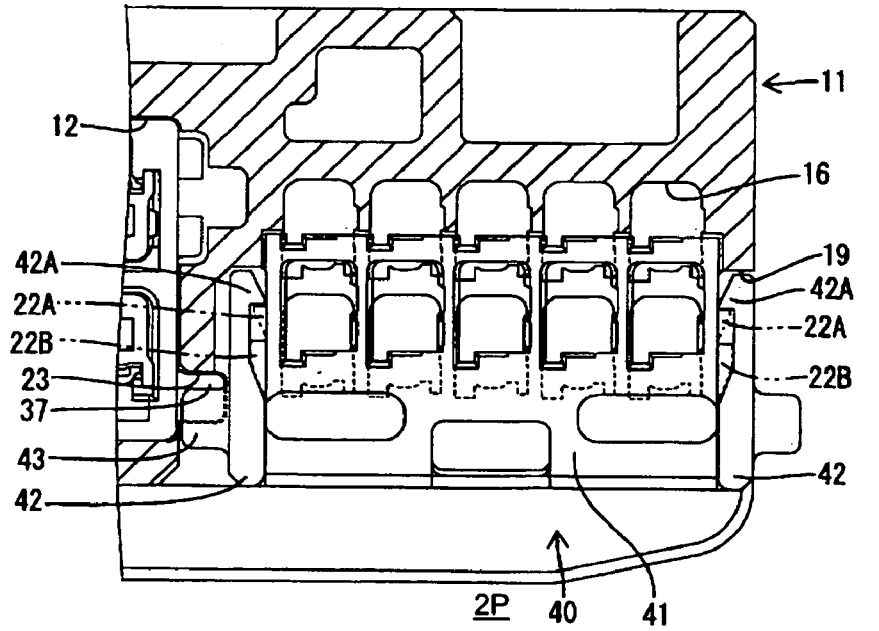
Figure 7:
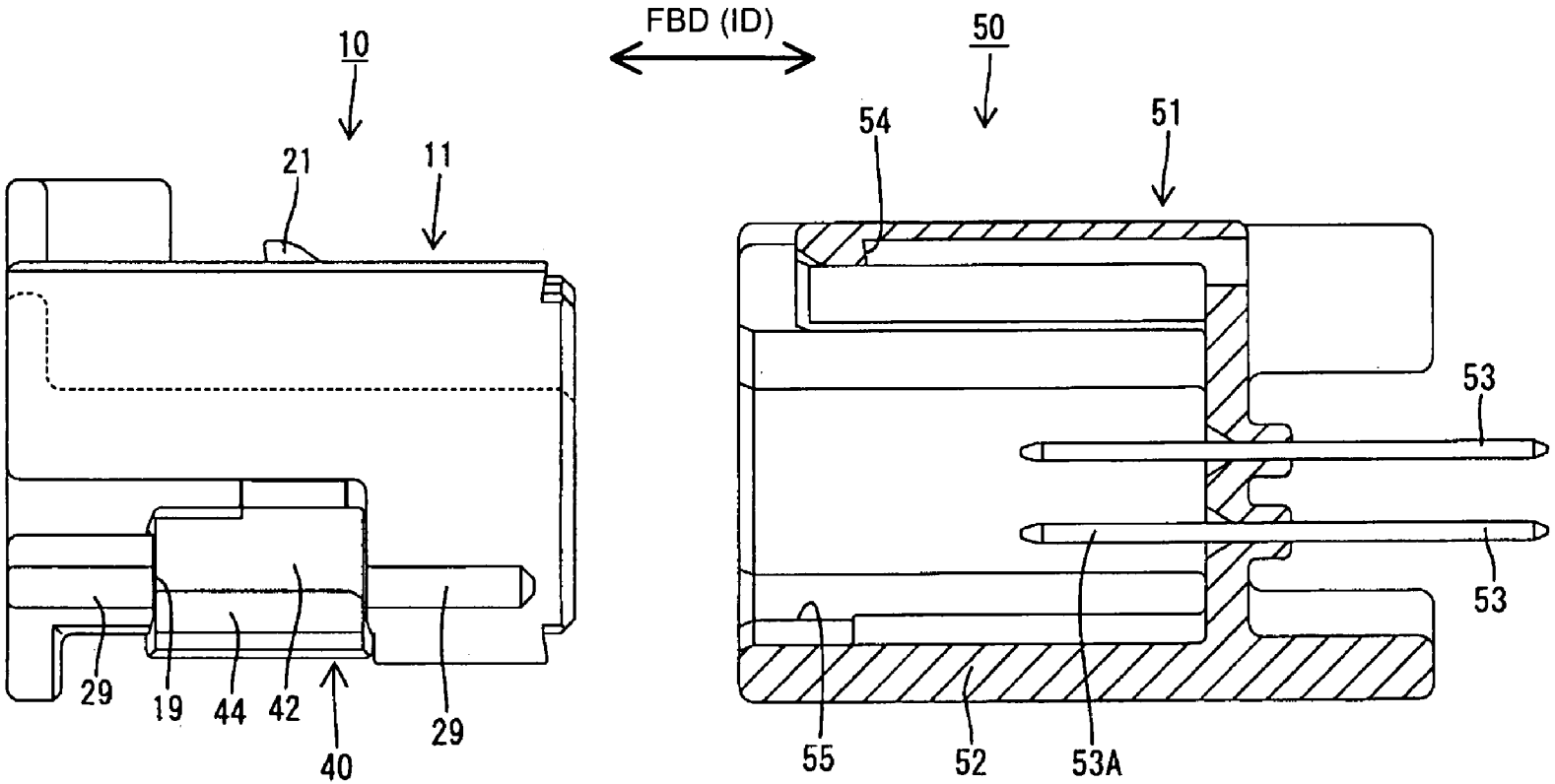
FIG. 7 is a side view in section of the male and female connectors when the retainer is located at the partial locking position.

Each retainer 40 is made e.g. of a synthetic resin and has a lattice-shaped main body 41. Plate-shaped sidewalls 42 extend from opposite left and right edges of the main body 41 along forward and backward directions FBD, as shown in FIGS. 1, 6 and 7. The retainer 40 can be held at a partial locking position 1P having a short depth of insertion (see FIG. 6(A)) and a full locking position 2P having a long depth of insertion (see FIG. 6(B)) by engaging locking claws 42A at the inner surfaces of the upper ends of the side walls 42 with locking projections 22A, 22B on the surfaces of the housing main body 11 facing the retainer mount hole 19. The main body 41 of the retainer 40 is retracted from the cavities 16 to permit insertion and withdrawal of the female terminal fittings 15 at the partial locking position 1P. However, the main body 41 enters the cavities 16 to lock the female terminal fittings 15 and to prevent the female terminal fittings 15 from coming out at the full locking position 2P.

Figure 8A:
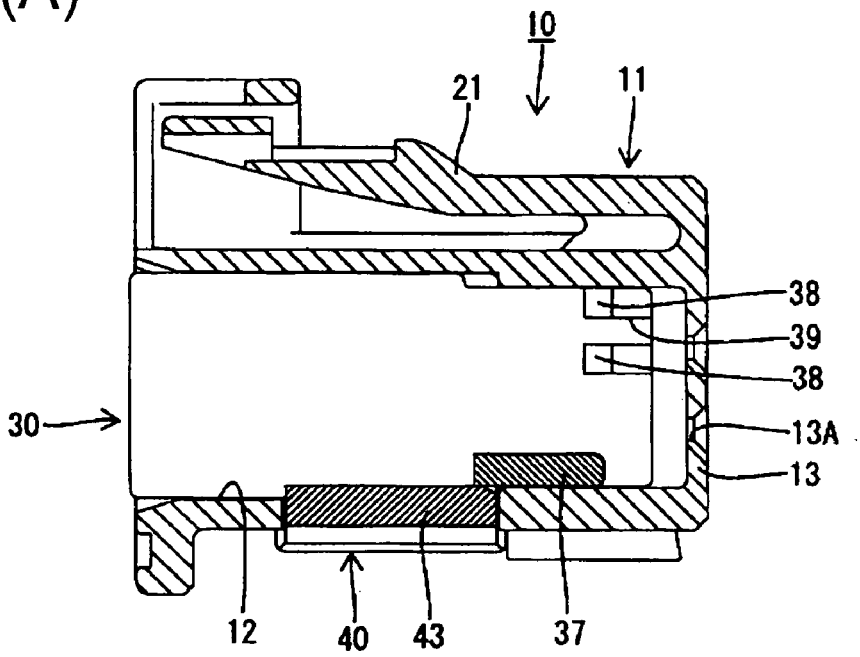
FIGS. 8(A) and 8(B) are side views in section showing a state where a movement of the retainer by pushing is prevented and a state where the retainer is pushed to the full locking position.
Figure 8B:
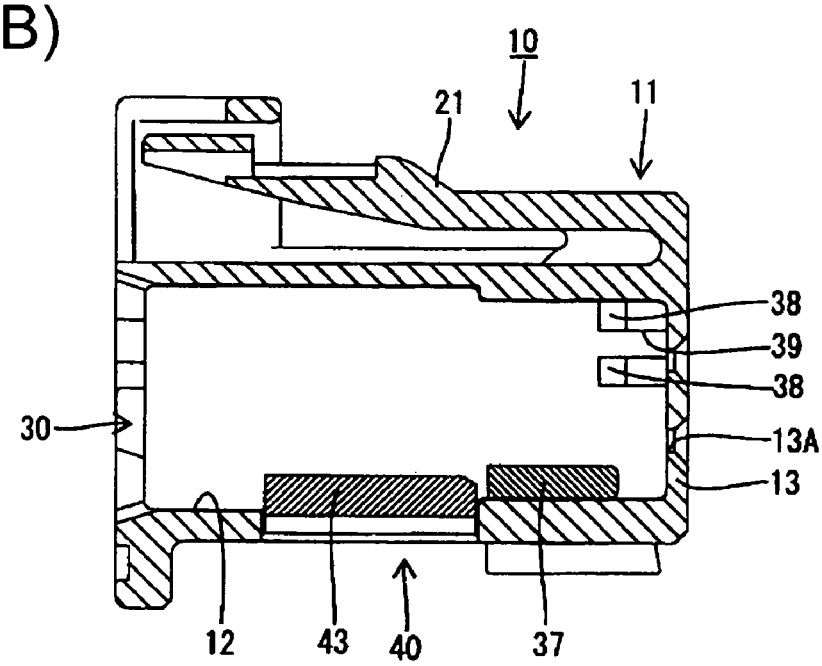

Error insertion preventing ribs 37 project near the front end at each of the left and right surfaces of the auxiliary connector 30 and extend parallel to the forward and backward directions FBD (see e.g. FIGS. 7 and 8). Error preventing grooves 23 extend along forward and backward directions FBD at the bottom of the inner side surfaces of the accommodating portion 12 in the housing main body 11 (see FIG. 4) and receive the error insertion preventing ribs 37. The error insertion preventing ribs 37 and the error insertion preventing grooves 23 prevent upside-down insertion of the auxiliary connector 30. Detecting ribs 43 project at a bottom part of the outer surface of the side wall 42 of each retainer 40 closer to the accommodating portion 12 (see FIGS. 6 and 8) and extend along forward and backward directions FBD. The detecting ribs 43 enter the error insertion preventing grooves 23 of the accommodating portion 12 in the housing main body 11 when the retainer 40 is at the full locking position 2P (see FIG. 6(B)), but are retracted from them when the retainer 40 is at the partial locking position 1P (see FIG. 6(A)). The error insertion preventing ribs 37 of the auxiliary connector 30 do not interfere with the detecting ribs 43 of the retainer 40 when the auxiliary connector 30 is at the proper mount position (see FIG. 8(B)). Thus, the retainer 40 can move from the partial locking position 1P to the full locking position 2P. However, the error insertion preventing ribs 37 interfere with the detecting ribs 43 when the auxiliary housing 30 is displaced back from the proper mount position. Thus, the retainer 40 cannot be pushed to the full locking position 2P (see FIG. 8(A)).

Figure 9:
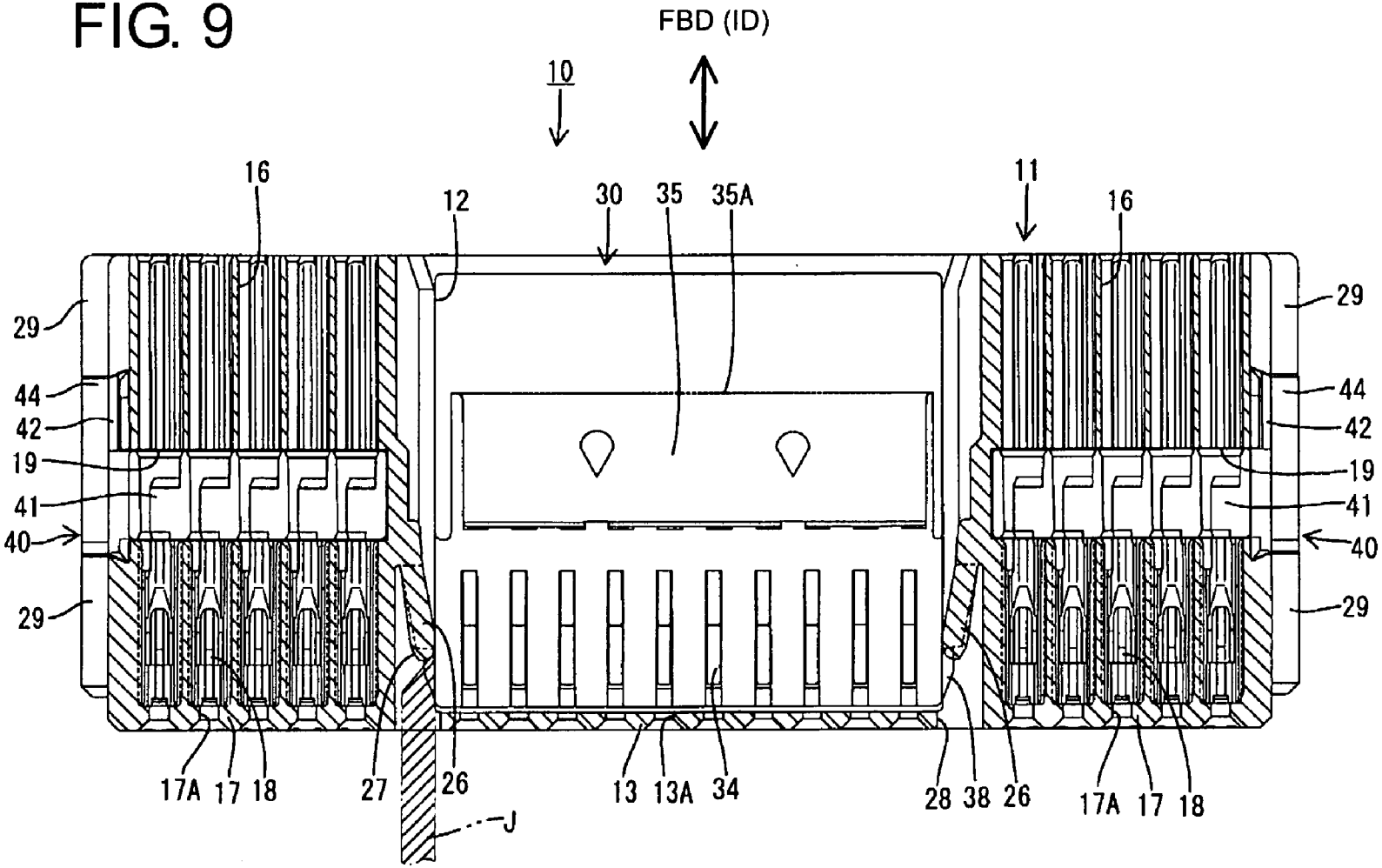
FIG. 9 is a plan view in section showing a state where a jig for unlocking the auxiliary connector is inserted.
Figure 10:
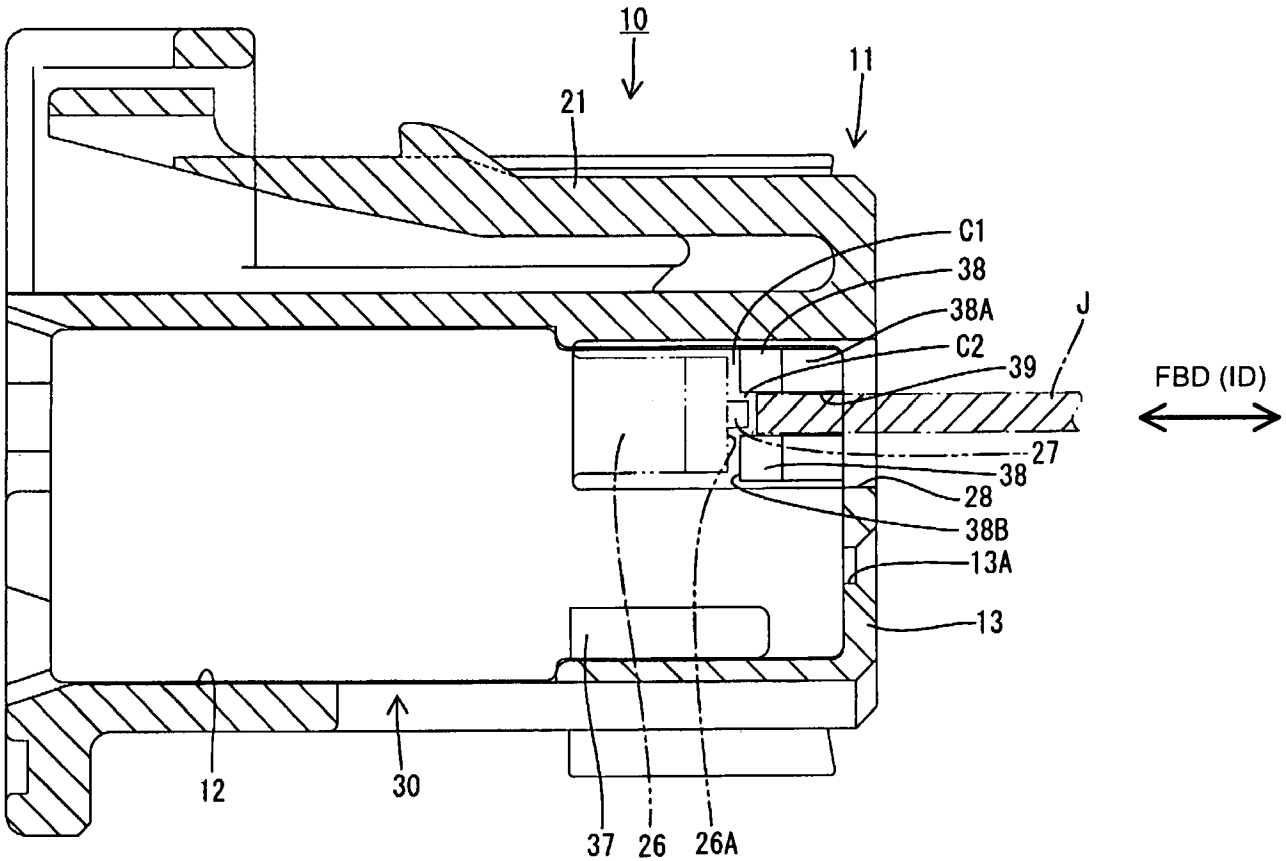
FIG. 10 is a side view in section showing a state where the jig for unlocking the auxiliary connector is inserted.

As shown in FIGS. 9 to 11, resiliently deformable plate-shaped locks 26 extend obliquely in toward the front at upper parts of the inner left and right surfaces of the accommodating portion 12 of the housing main body 11. Each lock 26 is transversely deformable away from the auxiliary housing 30. A locking surface 26A is formed at the leading end of the lock 26 and is inclined in towards the front with respect to an insertion direction ID of the auxiliary housing 30 into the accommodating portion 12.

Vertically spaced upper and lower locking projections 38 are formed at the front upper end of each of the opposite side surfaces of the auxiliary connector 30 and a groove 39 extends forward and backward therebetween. A moderately sloped guiding surface 38A is formed at the front of each locking projection 38, and an undercut locking surface 38B is at the rear surface thereof. The locking surface 26A of the lock 26 is engageable with the locking surface 38B. A disengaging projection 27 projects substantially in the vertical middle of the locking surface 26A of each lock 26. The disengaging projection 27 enters a clearance between the upper and lower locking projections 38 when the locking surface 26A engages the locking surfaces 38B of the locking projections 38. An introducing surface 27A is formed on the disengaging projection 27A and is rounded convexly towards the accommodating portion 12. The locking piece 26 can be deformed resiliently in unlocking direction ULD intersecting the forward and backward directions FBD by inserting the leading end of a jig J into a clearance between the introducing surface 27A and the side surface of the auxiliary connector 30 while the locking piece 26 is engaged with the locking projections 38. Unlocking windows 28 are formed in the front wall 13 of the housing main body 11 at positions before the locking pieces 26 for receiving the jig J. As shown in FIG. 10, the locking piece 26 and the locking projections 38 are spaced apart along forward and backward directions FBD and a direction substantially normal thereto. Thus, specified clearances C1, C2 are defined and are set to be larger than a clearance between the auxiliary connector 30 and the inner wall of the accommodating portion 12.

As shown in FIG. 7, error connection preventing ribs 29 project substantially along a connecting direction of the female connector 10 with the male connector 50 on lower parts of substantially opposite left and right surfaces of the housing main body 11. Each error connection preventing rib 29 has front and rear sections at opposite sides of the retainer mount hole 19. On the other hand, error connection preventing ribs 44 extend substantially along forward and backward directions FBD on the outer surfaces of the outer side walls 42 of the respective retainers 40. The error connection preventing ribs 44 align with the error connection preventing ribs 29 of the housing main body 11 substantially along the connecting direction when the retainer 40 is at the full locking position 2P. However, the error connection preventing ribs 44 are displaced down substantially normal to the forward and backward directions FBD from the error connection preventing ribs 29 of the housing main body 11 when the retainer 40 is at the partial locking position 1P.

Figure 12:
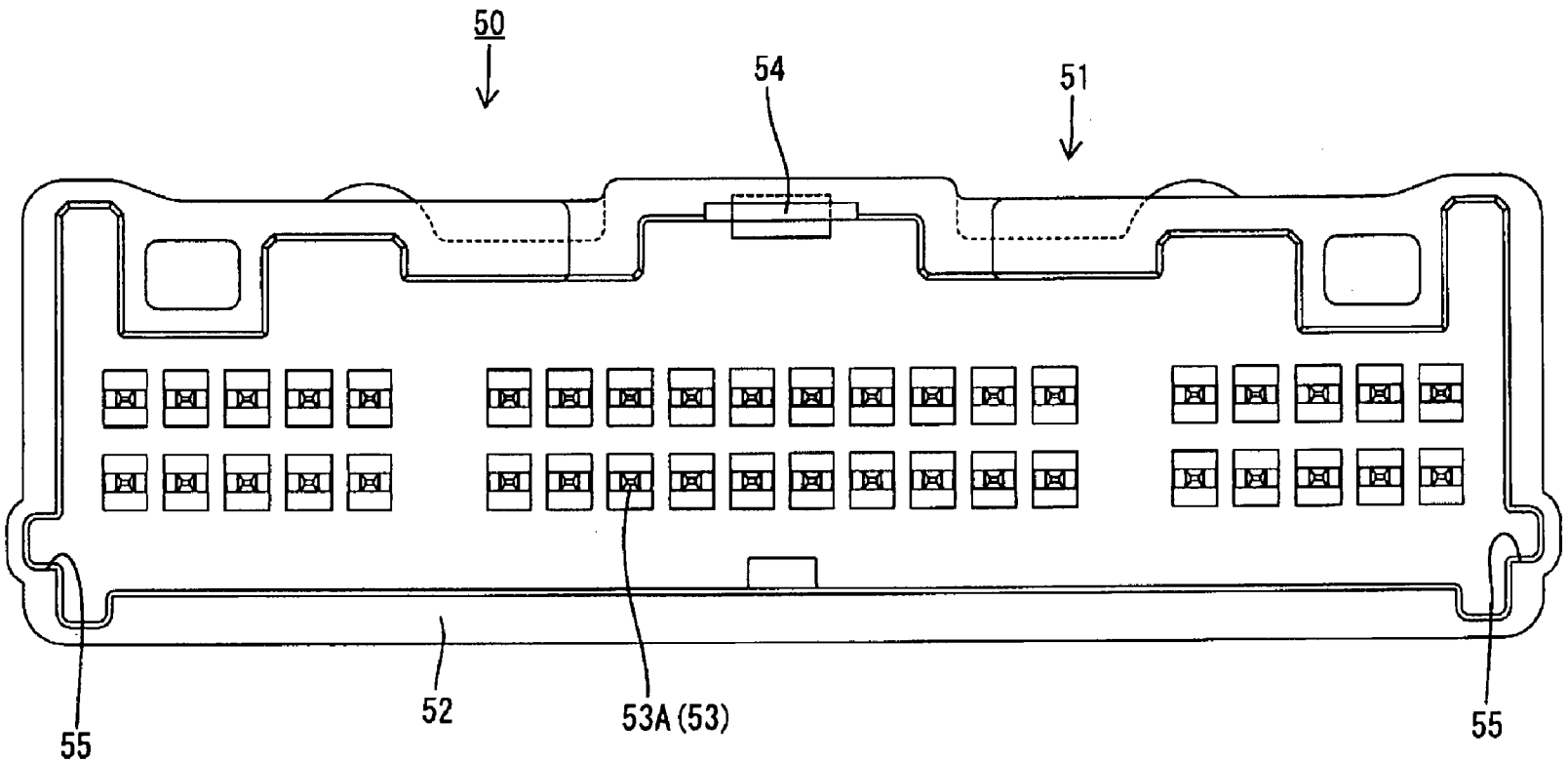
FIG. 12 is a front view of the male connector.

The male connector 50 includes a male housing 51 made e.g. of a synthetic resin as shown in FIGS. 7, 12 and 13. A fitting portion 52 in the form of a wide receptacle is provided on the front surface of the male housing 51, and the female connector 10 is fittable into the fitting portion 52. Male terminal fittings 53 are pressed into the back end surface of the fitting portion 52 at positions corresponding to the respective cavities 16, 32 of the female connector 10. Each male terminal fitting 53 includes a tab 53A projecting into the fitting portion 52. Projecting distances of the tabs 53A from the back end surface of the fitting portion 52 all are substantially equal. A receiving portion 54 is formed substantially in the transverse center of the ceiling of the fitting portion 52 and is engageable with the lock arm 21 of the housing main body 11 to lock the male and female housings 51, 11 in their properly connected state. Error connection preventing grooves 55 are formed along forward and backward directions FBD at lower parts of the opposite left and right inner surfaces of the fitting portion 52 for receiving the error connection preventing ribs 29, 44 of the housing main body 11 and the retainer 40. The error connection preventing ribs 29, 44 and the error connection preventing grooves 55 prevent upside-down insertion of the male connector 10.

The auxiliary connector 30 is assembled by inserting the female terminal fittings 31 into the corresponding cavities 32 and then closing the retainers 35 to doubly lock the female terminal fittings 31 (see FIG. 3).

The retainers 40 then are mounted at their partial locking positions 1P in the housing main body 11, and the auxiliary connector 30 is inserted along the inserting direction ID into the accommodating portion 12 from behind. An attempt may be made to insert the auxiliary connector 30 upside down. However, the error insertion preventing ribs 37 will catch the opening edge of the accommodating portion 12 to hinder the insertion and to detect the erroneous orientation. The guiding surfaces 38A of the locking projections 38 on the properly oriented auxiliary connector 30 contact the locks 26 as the insertion progresses and deform the locks 26 out in the direction ULD. The front wall 33 of the auxiliary connector 30 contacts the front wall 13 of the accommodating portion 12 when the auxiliary connector 30 is inserted to the proper mount position. At this time, the locks 26 are restored resiliently inward and the locking surfaces 26A thereof engage the locking surfaces 38B of the locking projections 38. Thus, the auxiliary connector 30 is locked so as not to come out (see FIG. 9).

The female terminal fittings 15 subsequently are inserted into the corresponding cavities 16 of the housing main body 11, and each retainer 40 is pushed from the partial locking position 1 P to the full locking position 2P. The retainer 40 could be pushed before the auxiliary connector 30 reaches the proper mount position. However, the detecting rib 43 of the retainer 40 contacts the error insertion preventing rib 37 in the error insertion preventing groove 23, as shown in FIG. 8(A). Accordingly, the retainer 40 cannot be pushed to the full locking position 2P and the insufficient insertion of the auxiliary connector 30 is detected. The retainer 40 can be pushed to the full locking position 2P when the auxiliary connector 30 is at the proper mount position. Thus, the detecting rib 43 enters the error insertion-preventing groove 23 without interfering with the error insertion preventing rib 37 of the auxiliary connector 30 (FIG. 8(B)). As a result, the retainer 40 reaches the full locking position 2P and doubly locks the female terminal fittings 15 in the cavities 16. Additionally, the detecting rib 43 engages the rear surface of the error insertion preventing rib 37 of the auxiliary connector 30 and doubly locks the auxiliary connector 30. In this way, assembly of the female connector 10 is completed.

Next, the male and female connectors 50, 10 are opposed to each other, as shown in FIGS. 1 and 13. The female connector 10 then is fit into the fitting portion 52 and the error connection preventing ribs 29 of the housing main body 11 enter the error connection preventing grooves 55 of the male housing 51. Here, the error connection preventing ribs 29 of the housing main body 11 and the error connection preventing ribs 44 of the retainers 40 align, if the retainers 40 are pushed properly to their full locking positions 2P. As a result, the error connection preventing ribs 29, 44 enter the error connection preventing grooves 55 of the male housing 51 to continue the fitting operation. On the other hand, a retainer 40 may be left at the partial locking position 1P. This may occur if it was forgotten to push the retainers 40 to the full locking positions 2P or if the retainers 40 cannot be pushed to the full locking positions 2P because the auxiliary connector 30 is inserted insufficiently. An attempt could be made to connect the male and female connectors 10, 50 in this state. However, the error connection preventing ribs 44 of the retainers 40 are displaced from the error connection preventing ribs 29 of the housing main body 11 and interfere with the opening edge of the fitting portion 52 to prevent further connection. In this way, the insufficient insertion of the retainers 40 is detected.

As the connection of the male and female connectors 50, 10 deepens, the tabs 53A of the male terminal fittings 53 enter the cavities 16, 32 through the tab insertion holes 17A of the front walls 17 or through the tab insertion holes 13A of the front wall 13 and the tab insertion holes 33A of the front walls 33. The female terminal fittings 31 in the auxiliary connector 30 are located behind the female terminal fittings 15 in the housing main body 11 by the dimension d. Thus, the tabs 53A having entered the cavities 16 of the housing main body 11 are inserted first into the female terminal fittings 15. Subsequently the tabs 53A, having entered the cavities 32 of the auxiliary connector 30, are inserted into the female terminal fittings 31. An insertion resistance Pa between the male and female terminal fittings 53, 15 suddenly increases to a peak value due to resilient restoring forces of the resilient contact pieces 15A immediately after the contact of the leading ends of the tabs 53A with the resilient contact pieces 15A. The insertion resistance Pa then decreases and the deformation of the resilient contact pieces 15A stops being held in sliding contact with the tabs 53A. Thus, the insertion resistance Pa becomes substantially stable at a low value (e.g. less than about ¾ of the peak value). An insertion resistance Pb between the female terminal fittings 31 in the auxiliary connector 30 and the tabs 53A shows a tendency similar to the insertion resistance Pa, but reaches its peak value later because the female terminal fittings 31 are displaced back from the female terminal fittings 15 by the distance d. An insertion resistance Pc between the tabs 53A and the corresponding female terminal fittings 15, 31 is a sum of the insertion resistance Pa between the female terminal fittings 15 and the tabs 53A and the insertion resistance Pb between the female terminal fittings 31 and the tabs 53A. A peak value thereof is lower than a peak value of an assumed insertion resistance Pd (about twofold of Pa) that would occur if the female terminal fittings 31 started contacting the tabs 53A at the same time as the female terminal fittings 15. Thus, a peak value of a connection resistance between the male and female connectors 50, 10 is reduced.

Figure 15:
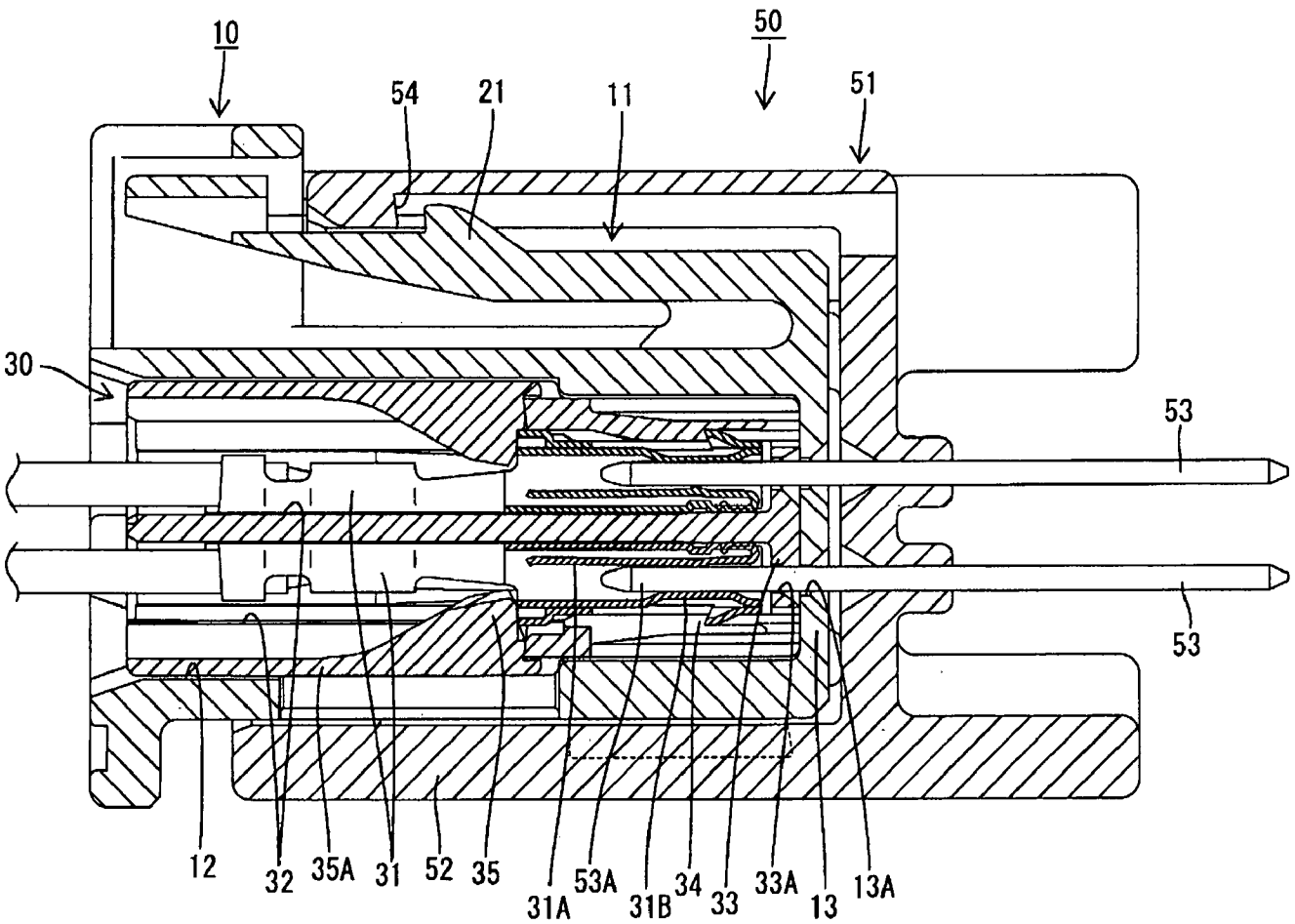
FIG. 15 is a side view in section showing a state where the male and female connectors are properly connected.

The female connector 10 is pushed to the back wall of the fitting portion 52. Thus, the lock arm 21 engages the receiving portion 54 to lock the housings 51, 11 in their properly connected state as shown in FIG. 15.

Figure 11B:
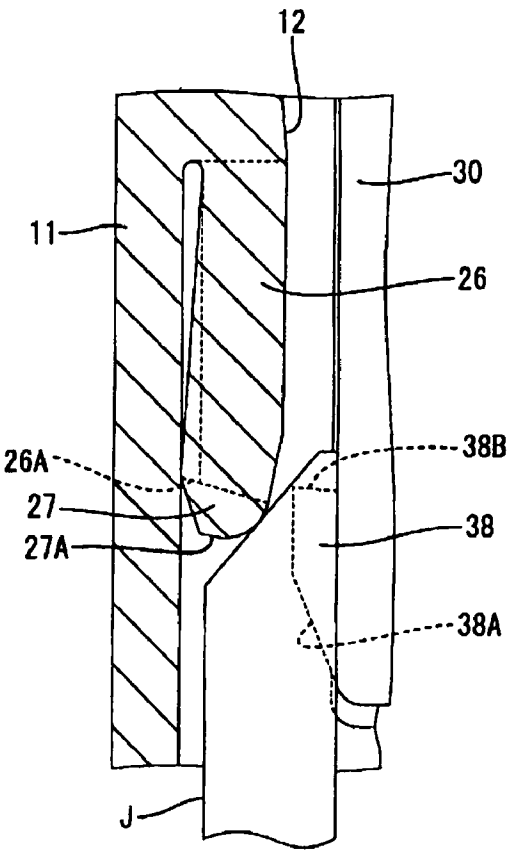
FIGS. 11(A) and 11(B) are partial enlarged plan views in section showing a state where the jig is in contact with a locking piece and a state where the locking piece is unlocked by the jig.
Figure 11A:
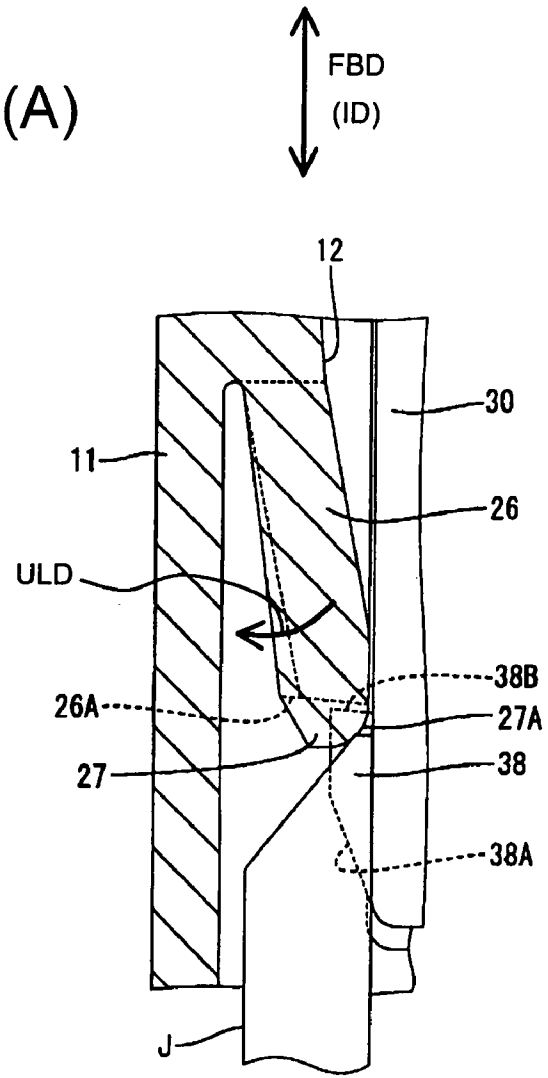

The auxiliary connector 30 may have to be detached from the housing main body 11 for maintenance or other reason. Thus, the retainers 40 are pushed from the full locking positions 2P to the partial locking positions 1P. Subsequently, as shown in FIGS. 9 and 10, the pointed end of a jig J is inserted into the unlocking window 28 of the housing main body 11. The leading end of the jig J is fit into the groove 39 between the upper and lower locking projections 38 and slides towards the back. The leading end of the jig J then enters the clearance between the guiding surface 27A of the disengaging projection 27 and the side surface of the auxiliary connector 30 to contact the introducing surface 27A, as shown in FIG. 11(A). Here, the jig J is guided by the groove 39 formed between the pair of locking projections 38 to a position to contact the disengaging projection 27. Thus, operability is good.

The jig J is pushed further towards the back. Thus, the lock 26 is guided by the introducing surface 27A of the disengaging projection 27 and deforms resiliently in the unlocking direction ULD towards a side away from the side surface of the auxiliary connector 30, as shown in FIG. 11(B). Thus, the locking surface 26A of the lock 26 and the locking surface 38B of the locking projection 38 disengage. The auxiliary connector 30 can be pulled back out of the accommodating portion 12 with respect to the housing main body 11 after the left and right locks 26 are disengaged.

As described above, the mount positions of the main female terminal fittings 15 are displaced by the distance d from those of the auxiliary female terminal fittings 31 substantially along the forward and backward directions FBD. Thus, the insertion resistance Pa created between the female terminal fittings 15 and the mating tabs 53A peaks at a timing shifted from the insertion resistance Pb created between the female terminal fittings 31 and the tabs 53A. Accordingly, a peak value of a (total) connecting force to connect the male and female connectors 50, 10 (i.e. of the sum of the insertion resistances Pa and Pb) is reduced, thereby improving a connecting operability.

Further, a sum of the thickness along the forward and backward directions FBD of the auxiliary-connector front walls 33 for stopping the auxiliary female terminal fittings 31 at their front end positions and that of the front wall 13 for stopping the auxiliary connector 30 at its front end position exceeds the thickness of the main-body front walls 17 for stopping the main female terminal fittings 15 at their front end positions. Thus, the mount positions of the auxiliary female terminal fittings 31 are shifted back along the connecting direction (substantially parallel to the forward and backward directions FBD) from those of the main female terminal fittings 15 by the thickness difference (d). In this way, the connection timing of the auxiliary female terminal fittings 31 with the tabs 53A are delayed from that of the main female terminal fittings 15 with the tabs 53A by a simple construction.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The invention is also similarly applicable to male connectors accommodating male terminal fittings.

The invention is not limited to divided connectors using only terminal fittings of the same shape as in the foregoing embodiment, but is also applicable to hybrid divided connectors with terminal fittings of different shapes.

Although the number of the main-body side terminal fittings is equal to that of the auxiliary-connector side terminal fittings in the foregoing embodiment, the former may be larger or smaller than the latter.

Two or more auxiliary connector housings may be mounted into the housing main body. In such a case, mount positions of the auxiliary connector housings may be displaced along the connecting direction.

What is claimed is:

1. A divided connector, comprising:

a housing main body having an accommodating portion with an accommodating front wall at a front end of the accommodating portion, the housing main body further having main cavities for receiving main terminal fittings at least one main-body front wall at front ends of the main cavities for stopping the main terminal fittings at front end positions in the main cavities; and an auxiliary housing formed with auxiliary cavities for receiving auxiliary terminal fittings, at least one auxiliary-connector front wall at front ends of the auxiliary cavities for stopping the auxiliary terminal fittings at front end positions in the auxiliary cavities, the auxiliary housing being mountable into the accommodating portion so that a front end of the auxiliary housing is substantially at the accommodating front wall;

wherein mount positions of the main terminal fittings and mount positions of the auxiliary terminal fittings are displaced along a connecting direction of the divided connector with a mating connector.

2. The divided connector of claim 1, wherein the auxiliary fittings and the main fittings have substantially identical configurations.

3. The divided connector of claim 1, wherein a sum of thicknesses of the auxiliary-connector front walls and the accommodating front wall exceeds a thickness of the main-body front wall.

4. The divided connector of claim 1, further comprising a retainer mountable at a restricting position in the housing main body to lock the main terminal fittings in the housing main body.

5. A divided connector, comprising:

a housing main body having an accommodating portion and having main cavities for receiving main terminal fittings;

a retainer mountable at a restricting position in the housing main body to lock the main terminal fittings in the housing main body;

an auxiliary housing formed with auxiliary cavities for receiving auxiliary terminal fittings, the auxiliary housing being mountable into the accommodating portion;

wherein mount positions of the main terminal fittings and mount positions of the auxiliary terminal fittings are displaced along a connecting direction of the divided connector with a mating connector; and wherein the auxiliary housing is configured to avoid interference with the retainer and to permit the retainer to be mounted at the restricting position if the auxiliary housing is at a proper mount position in the housing main body, the auxiliary housing further being configured to interfere with the retainer and to prevent the retainer from being mounted to the restricting position if the auxiliary housing is displaced from the proper mount position.

6. The divided connector of claim 5, wherein the retainer is provided unitarily on the housing main body.

* * * * *